United States Patent [19]

Cheng

[11] Patent Number: 4,991,711

[45] Date of Patent: Feb. 12, 1991

[54] ARTIST STORAGE CONTAINER HAVING SCALLOPED HANDLES

[76] Inventor: Nancy C. Cheng, 3360 Byrd Ave., Allentown, Pa. 18103

[21] Appl. No.: 493,630

[22] Filed: Mar. 15, 1990

[51] Int. Cl.[5] ..... B65D 85/20; B44D 3/04

[52] U.S. Cl. ..... 206/1.7; 206/372; 220/94 R; 294/160; 294/163; 294/169; 312/DIG. 33

[58] Field of Search ..... 206/1.7, 1.8, 372, 375, 206/315.11, 373, 374; 220/94 R; 294/159–163, 169; 16/110.5; 312/DIG. 33

[56] References Cited

U.S. PATENT DOCUMENTS

| | | | |
|---|---|---|---|
| 1,318,007 | 10/1919 | Gau | 294/169 X |
| 2,347,270 | 4/1944 | Larsson | 312/DIG. 33 |
| 2,383,058 | 8/1945 | Hanson | 312/DIG. 33 |
| 2,565,912 | 8/1951 | Davis | 206/1.7 |
| 3,050,356 | 8/1962 | Messmer | 206/315.11 X |
| 3,273,700 | 9/1966 | Moreau et al. | 206/1.7 |
| 3,370,696 | 2/1968 | Groe | 294/161 |
| 3,389,945 | 6/1968 | Thomas | 206/1.7 |
| 3,426,888 | 2/1969 | Meth | 206/1.8 |
| 3,576,252 | 4/1971 | Conolly | 206/1.7 |
| 3,672,742 | 6/1972 | Barg | 206/1.7 X |
| 3,786,913 | 1/1974 | Crawford | 206/1.8 |
| 4,335,812 | 6/1982 | Koves | 206/1.8 |
| 4,765,457 | 8/1988 | Rayhle | 206/1.8 |

*Primary Examiner*—Bryon P. Gehman
*Attorney, Agent, or Firm*—Leon Gilden

[57] ABSTRACT

An apparatus including a base container defined by spaced, elongate side walls and orthogonally mounted end walls. The end walls include a first and second handle mounted thereto utilizing "C" shaped brackets, wherein the brackets include intercommunicating, longitudinally aligned handles extending between adjacent pairs of the brackets, wherein the handles each include forward scalloped edges arranged to interfit in an interdigited relationship. An abutment block orients the scalloped edges in a horizontal relationship relative to upper scalloped edges of the storage container for positioning of artist brushes thereon during a painting procedure. The contents of the container includes a plurality of removable storage compartments and a compartmentalized tray with an overlying lid mounted thereover, wherein the lid further includes a scalloped upper edge for positioning of various brushes and the like thereon. The handles are arranged wherein a forward handle may be aligned in a horizontal relationship, while a rear handle may be positioned in a vertical relationship to utilize the apparatus as an easel.

6 Claims, 4 Drawing Sheets

ARTIST STORAGE CONTAINER HAVING SCALLOPED HANDLES

BACKGROUND OF THE INVENTION

1. Field of the Invention

The field of invention relates to storage containers, and more particularly pertains to a new and improved artist storage container wherein the same provides removable containers for storage of various components within the organization, as well as the arrangement of various edges of the organization for positioning of brushes, pencils, and other drawing implements during use. The storage container may also serve as a dual water basin for painting water color if so desired.

2. Description of the Prior Art

Containers for the storage of various supplies is well known in the prior art. The prior art has set provision for the use of containers for particular applications such as those utilized by artists and the like. The instant invention attempts to overcome disadvantages of the prior art by setting forth an operative organization wherein the container provides a multi-function structural arrangement to enable utilization of the organization for storage and positioning of various drafting instruments utilized by artists, as well as the utilization of the organization as an easel for positioning of an artist's canvas thereon. Examples of the prior art include U.S Pat. No. 3,389,945 to Thomas wherein a water color kit is provided with various compartments and brackets for use with an associated artist easel.

U.S. Pat. No. 3,786,913 to Crawford provides an artist's paint box formed with a lid overlying an aligned series of artist colors and storage for brushes.

U.S. Pat. No. 2,565,912 to Davis sets forth a water color paint set provided with a support stand and an annular storage tray for mounting of various water colors thereon.

U.S. Pat. No. 3,426,888 to Meth provides a coloring set for storage of brushes, water, and various coloring mediums.

U.S. Pat. No. 4,765,457 provides artist storage structure wherein a slidable tray is mounted within a storage container with an overlying lid mounted thereover, with provision for storage of associated water for use by the various coloring pigments stored within the organization.

As such, it may be appreciated that there is a continuing need for a new and improved artist storage container wherein the same sets forth provision for the multi-function utilization of the container as storage and as accessory support during use during a painting procedure and in this respect, the present invention substantially fulfills this need.

SUMMARY OF THE INVENTION

In view of the foregoing disadvantages inherent in the known types of storage containers now present in the prior art, the present invention provides an artist storage container wherein the same provides storage for multi-compartmented containers therewithin as well as providing for temporary securement positioning of various artist implements during use in a painting procedure. As such, the general purpose of the present invention, which will be described subsequently in greater detail, is to provide a new and improved artist storage container which has all the advantages of the prior art storage containers and none of the disadvantages.

To attain this, the present invention provides an apparatus including a base container defined by spaced, elongate side walls and orthogonally mounted end walls. The end walls include a first and second handle mounted thereto utilizing "C" shaped brackets, wherein the brackets include intercommunicating, longitudinally aligned handles extending between adjacent pairs of the brackets, wherein the handles each include forward scalloped edges arranged to interfit in an interdigited relationship. An abutment block orients the scalloped edges in a horizontal relationship relative to upper scalloped edges of the storage container for positioning of artist brushes thereon during a painting procedure. The contents of the container include a plurality of removable storage compartments and a compartmentalized tray with an overlying lid mounted thereover, wherein the lid further includes a scalloped upper edge for positioning of various brushes and the like thereon. The handles are arranged wherein a forward handle may be aligned in a horizontal relationship, while a rear handle may be positioned in a vertical relationship to utilize the apparatus as an easel.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved artist storage container which has all the advantages of the prior art storage containers and none of the disadvantages.

It is another object of the present invention to provide a new and improved artist storage container which may be easily and efficiently manufactured and marketed.

It is a further object of the present invention to provide a new and improved artist storage container which is of a durable and reliable construction.

An even further object of the present invention is to provide a new and improved artist storage container which is susceptible of a low cost of manufacture with regard to both materials and labor, and which accordingly is then susceptible of low prices of sale to the consuming public, thereby making such artist storage containers economically available to the buying public.

Still yet another object of the present invention is to provide a new and improved artist storage container which provides in the apparatuses and methods of the prior art of the advantages thereof, while simultaneously overcoming some of the disadvantages normally associated therewith.

Still another object of the present invention is to provide a new and improved artist storage container wherein the same sets forth provision for storage of various components during non-use of the apparatus, as well as providing means for securement of various drawing instruments during utilization of the organization during a painting procedure, as well as providing structure for use of the organization as an easel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the instant invention for use as an easel.

DESCRIPTION OF THE PREFERRED EMBODIMENT

Figures 1, 2:
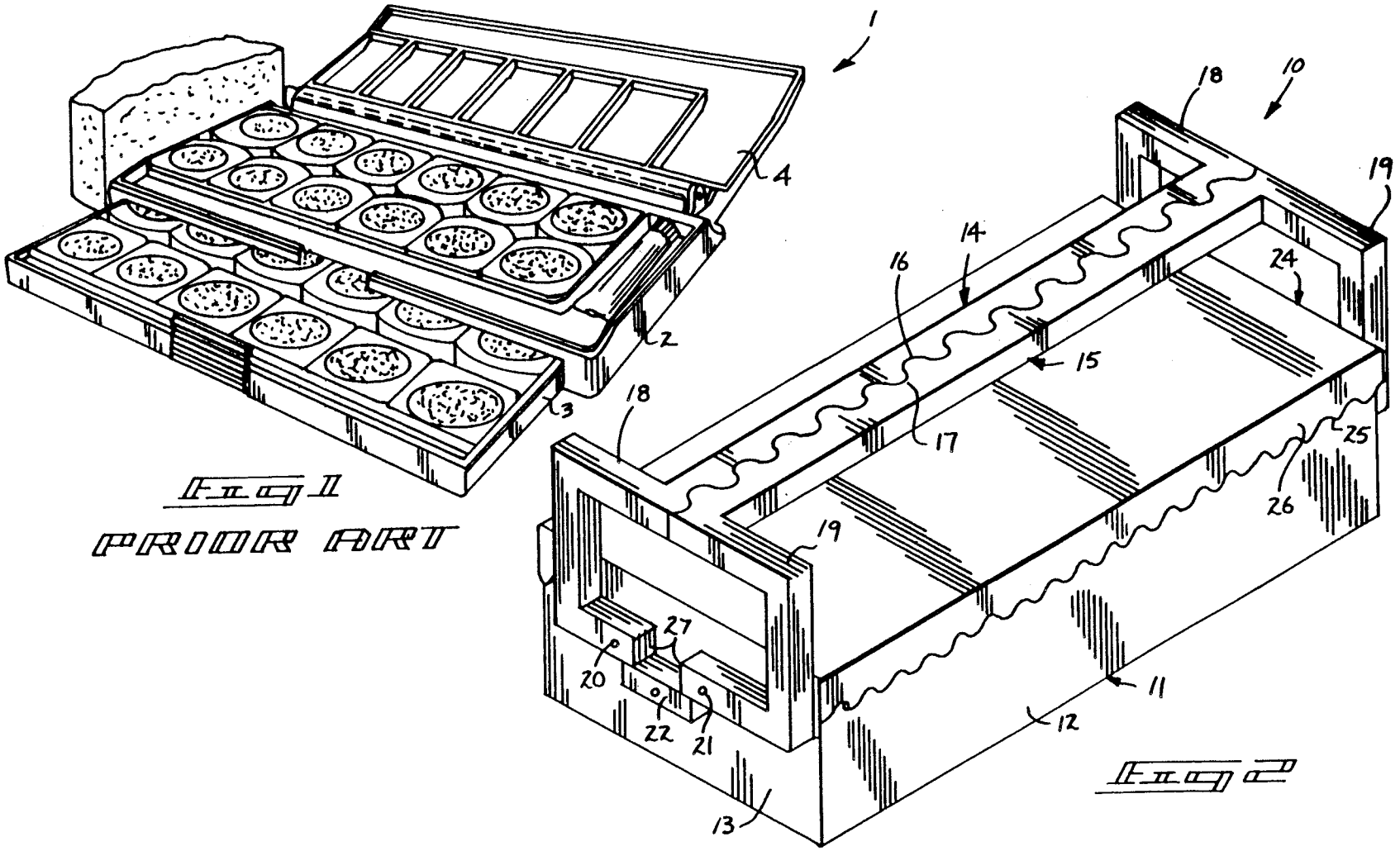
FIG. 1 PRIOR ART
FIG. 1 is an isometric illustration of a prior art artist-type storage container.
FIG. 2 is an isometric illustration of the instant invention in a closed configuration.

With reference now to the drawings, and in particular to FIGS. 1 to 7 thereof, a new and improved artist storage container embodying the principles and concepts of the present invention and generally designated by the reference numeral 10 will be described.

FIG. 1 is illustrative of a typical prior art storage container 1 for use by an artist, wherein a base compartment 2 includes a slidable tray telescopingly mounted therewithin and a lid 4 pivotally arranged to overlie and secure the organization.

Figures 3, 4:
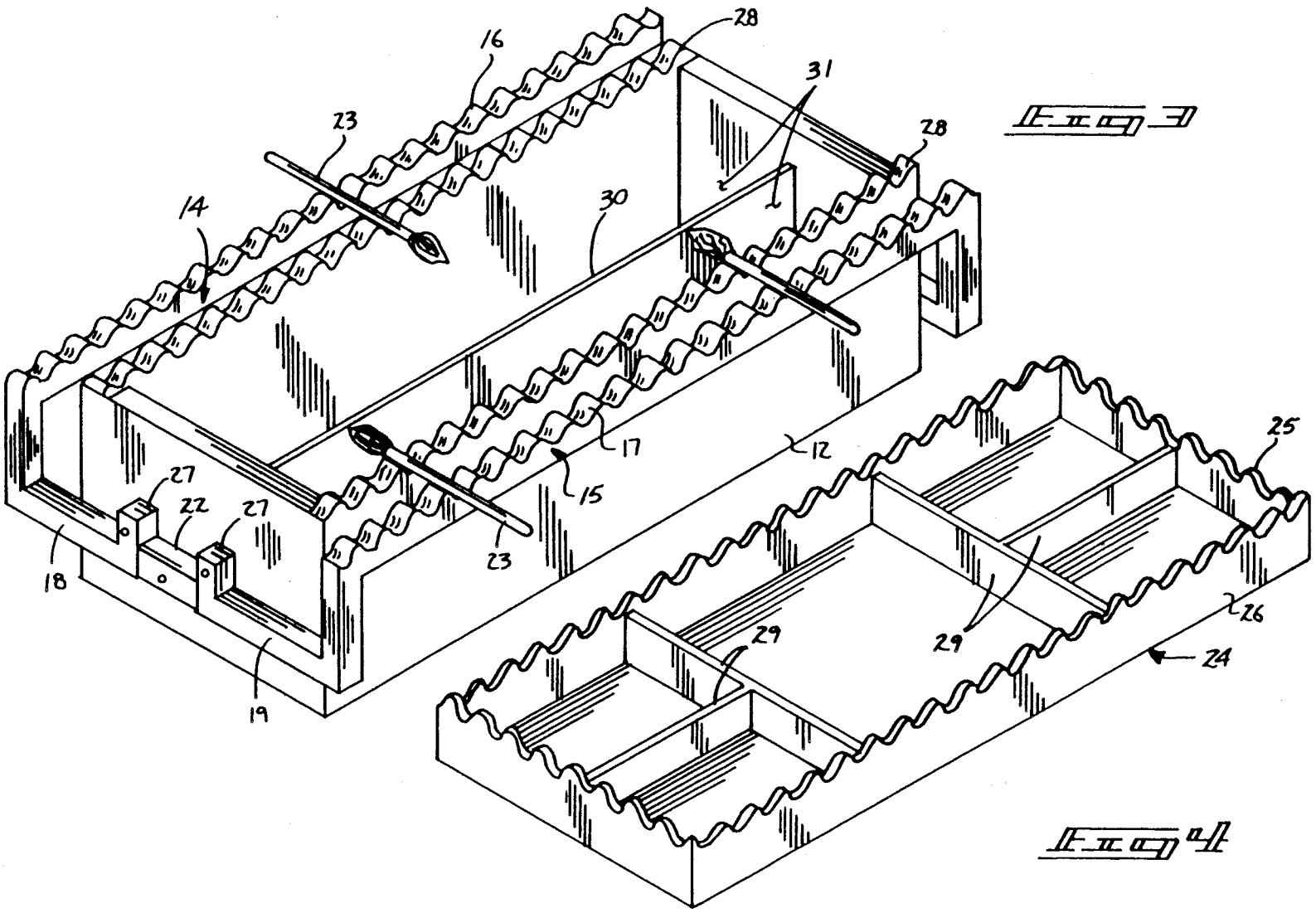
FIG. 3 is an isometric illustration of the instant invention in an opened configuration with various components removed therefrom.
FIG. 4 is an isometric illustration of the lid of the instant invention for use as a tray.
Figures 5, 6:
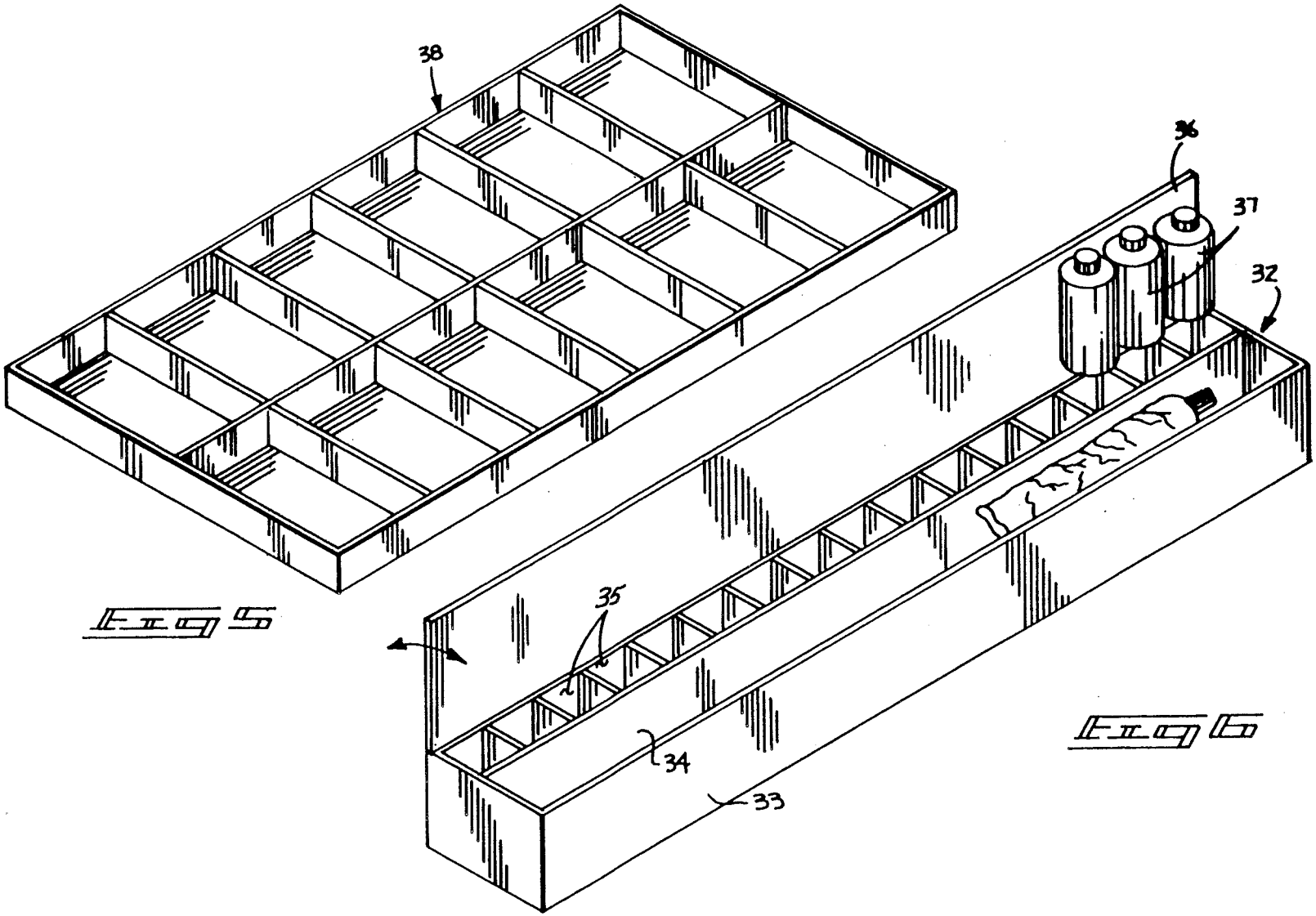
FIG. 5 is an isometric illustration of a tray positionable within the container of the instant invention.
FIG. 6 is an isometric illustration of one of a plurality of storage insert containers utilized by the instant invention.
Figure 11:
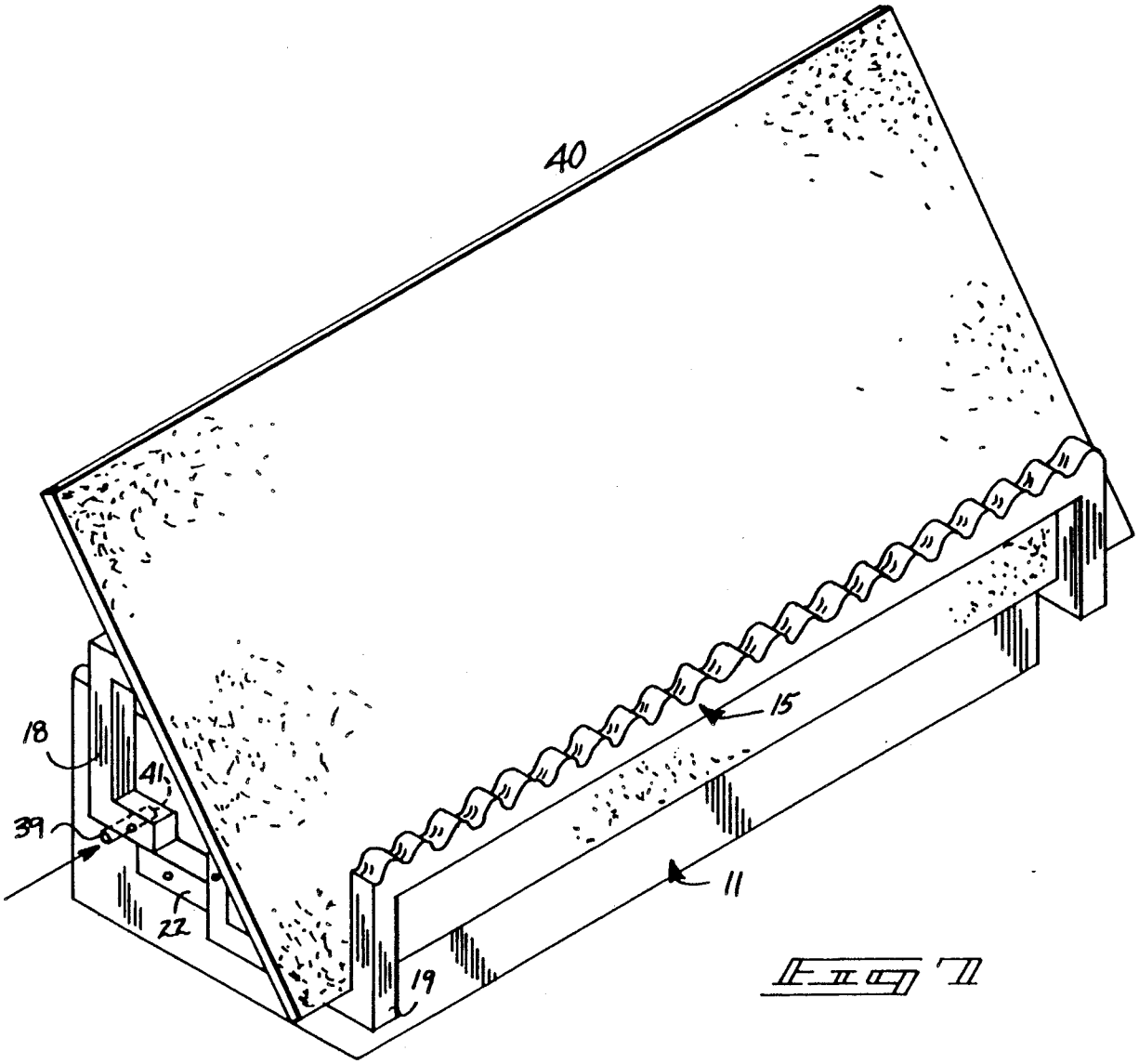

More specifically, FIG. 2 is illustrative of the artist storage container 10 of the instant invention including a container 11 defined by spaced side walls 12 and orthogonally arranged end walls 13 interconnecting the side walls. A first handle 14 and a second handle 15 are pivotally mounted to the end walls 13, wherein the handles 14 and 15 each include a respective first and second scalloped forward edge surface 16 and 17 respectively. The scalloped edge surfaces of the first and second handles are defined by offset projections to enable reception of projections of the first forward edge surface 16 within the recesses of the second forward edge 17 to define an interdigited engagement structure, as illustrated in FIG. 2. The first and second handles 14 and 15 are provided with respective pairs of first and second "C" shaped support brackets 18 and 19 orthogonally mounted to the handles 14 and 15 and provided with first pivots 20 and second pivots 21 respectively to pivotally mount the "C" shaped brackets to the end walls 13. The "C" shaped brackets are defined by confronting end surfaces 27 of the lower legs of the "C" shaped support brackets, wherein the confronting surfaces 27 are spaced apart a predetermined distance. An abutment block 22 underlying and adjacent bottom surfaces of the lower legs of the "C" shaped brackets is defined by a spacing greater than said predetermined distance, but defined by an abutment block distance equal to a spacing between the lower legs of the "C" shaped brackets 18 and 19 respectively when the handles 14 and 15 are in a lowered horizontal configuration, as illustrated in FIG. 8 for example. When so arranged in a horizontal configuration, the first and second scalloped forward edge surfaces 16 and 17 are generally aligned with the scalloped side wall upper free edge surfaces 28 of the side walls 12, as illustrated in FIG. 3. This arrangement enables a positioning of paint brushes 23 or other similar writing and drawing instruments for support about the spaced recesses of the scalloped edges 16 and 17 cooperating with the scalloped upper edge surfaces 28 of the side walls 12 The tray lid 14, as illustrated in FIG. 2, upon removal from the container 11 is positioned upon an exterior surface of its floor, as illustrated in FIG. 4, and is further provided with scalloped perimeter edge upper surfaces 25 of the side walls 26 of the lid 24. The lid 24 is also formed with compartmented partition walls 29 defined by a height less than that of the upper edge surfaces of the side walls 26 and their associated scalloped perimeter edges 25 to permit the scalloped edge portion 25 to overlie the side end walls 12 and 13 of the container 11 for use as a lid.

Reference to FIG. 3 also illustrates a longitudinally aligned partition wall 30 positioned to orthogonally divide the end walls 13 and is defined by a height less than that by the side and end walls to accommodate a compartment tray 38 within the container 11 overlying the partition wall 30. The partition wall 30 also is provided to receive a plurality of storage inserts to either side of the partition wall 30. The storage insert containers 82 are positionable within the side-by-side container compartments 31 defined by the partition wall 30 and includes a base compartment 33 defined by a single elongate compartment adjacent a series of partition compartments 35 to receive various paint containers 37 therewithin.

Reference to FIG. 7 illustrates the container 11 for use as an easel A locking dowel 39 is receivable within an associated bore 41 to lock the first handle 14 in a vertical configuration, as illustrated in FIG. 7, while the second handle 15 is arranged in a lowered horizontal configuration, as illustrated, to enable positioning of a planar support 40 to receive an artist canvas and the like thereon to permit sketching and performing of a painting procedure thereon.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. Artist supply storage container apparatus comprising in combination, an elongate housing including spaced side walls orthogonally joined to spaced end walls, a first handle including spaced support brackets orthogonally and integrally mounted to opposed ends of the first handle and pivotally mounted to opposed end walls, a second handle including spaced further support brackets integrally and orthogonally mounted to opposed terminal ends of the second handle pivotally mounting the spaced further support brackets to the opposed end walls, wherein a support bracket and a further support bracket are pivotally mounted to each end wall associated with each of the first and second handles, a lid member including a central web with a skirt continuously formed about the central web, the lid member removably and selectively mounted overlying the side walls and the end walls with the skirt surroundingly positionable about the side walls and end walls when the lid member is mounted overlying the side walls and end walls, a partition wall spaced below upper terminal ends of the side walls and end walls orthogonally and medially mounted to interior opposed surfaces of the end walls, a tray member overlying a partition member removably mounted within the housing, insert containers mounted within the housing on either side of the partition wall, the insert containers are defined by a predetermined length substantially equal to that defined by the partition wall, each of the first and second handles include respective first and second scalloped forward end edge surfaces, the first end edge surface defined by first end edge recesses and projections, and the second end edge surface defined by second end edge recesses and projections, wherein the second end edge recesses and projections are offset relative to the first end edge recesses and projections for interdigited securement of the first end edge projections within the second end edge recesses.

2. An apparatus as set forth in claim 1 wherein the support bracket and the further support bracket are of a generally "C" shaped confronting relationship, with a lowermost leg of the support bracket defining a first leg surface in confronting relationship to a second lower leg end surface when the first and second handles are in a raised configuration, and further including an abutment bracket underlying each support bracket and further support bracket and spaced apart a distance equal to a predetermined spacing of each support bracket and further support bracket when the first and second handles are in a lowered horizontal relationship.

3. An apparatus as set forth in claim 2 wherein the skirt of the lid member includes a perimeter side wall directed upwardly from the lid member, and wherein the side wall includes a scalloped upper edge, and the lid member further includes partition walls mounted interiorly of the side wall and positioned below the scalloped upper edge to enable the lid member to overlie the side walls and end walls.

4. An apparatus as set forth in claim 3 wherein the insert containers each include an elongate compartment and a series of further compartments coextensive with the elongate compartment, and further including a lid pivotally mounted overlying the elongate compartments and further compartments.

5. An apparatus as set forth in claim 4 further including a locking dowel positionable within a bore, the bore aligned with and adjacent an abutment block to lock the first handle in the vertical position and simultaneously allowing the second handle to pivot to the second horizontal position, and a planar support mounted within the second handle overlying the first handle for use as an easel.

6. An apparatus as set forth in claim 5 wherein the scalloped edge surfaces of the first and second handles are in alignment with the side wall end edge surfaces of the container when the first and second handles are in a lowered horizontal position.

* * * * *